United States Patent [19]

Alter et al.

[11] 4,441,447

[45] Apr. 10, 1984

[54] REMOVABLE RUDDER ASSEMBLY

[75] Inventors: Hobart L. Alter; Lewis F. Wake, both of Capistrano Beach; Myron G. Platten, Newport Beach, all of Calif.

[73] Assignee: Coast Catamaran Corporation, Oceanside, Calif.

[21] Appl. No.: 401,373

[22] Filed: Jul. 23, 1982

[51] Int. Cl.[3] ..... B63H 25/06

[52] U.S. Cl. ..... 114/167

[58] Field of Search ..... 114/128, 132, 133, 144 C, 114/162–169, 352; 403/314, 354, 358–359, 364, 375, 381, 383, 405–409; 280/276–280

[56] References Cited

U.S. PATENT DOCUMENTS

| | | | |
|---|---|---|---|
| 3,703,741 | 11/1972 | Foster et al. | 403/364 |
| 4,067,280 | 1/1978 | Serfess | 114/128 |
| 4,286,536 | 9/1981 | Alter | 114/165 |

FOREIGN PATENT DOCUMENTS

| | | | |
|---|---|---|---|
| 167442 | 1/1965 | U.S.S.R. | 114/162 |

*Primary Examiner*—Trygve M. Blix
*Assistant Examiner*—Jesús D. Sotelo

[57] ABSTRACT

A removable rudder assembly for a boat includes a rudder and upper and lower rudder shafts which are detachably connected together. The lower shaft is connected to the rudder, and connecting plugs are attached to the adjacent ends of the upper and lower shafts. A pair of wedge-shaped tongues on one plug extend into wedge-shaped recesses in the other plug. A rod extends through the upper shaft and the connecting plug attached thereto and is threadedly engaged with the connecting plug on the lower shaft to hold the two plugs together.

9 Claims, 13 Drawing Figures

FIG. 5
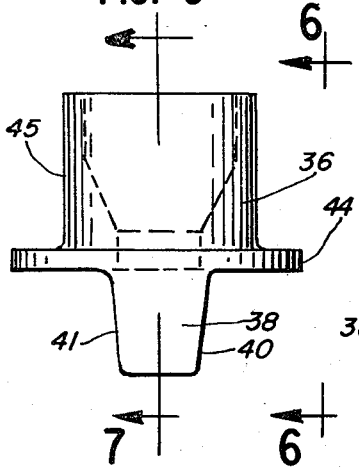
FIG. 6
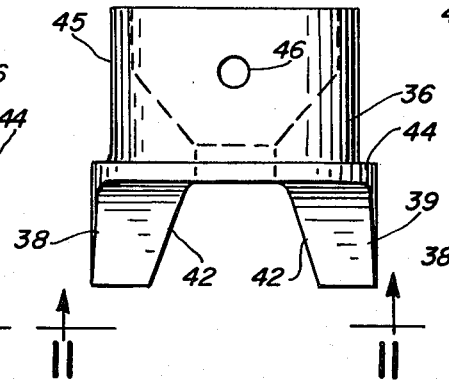
FIG. 7
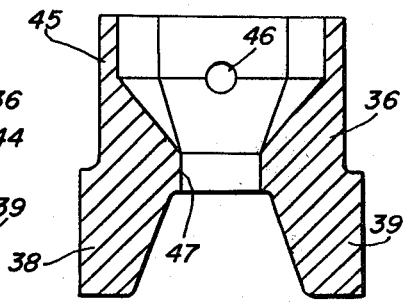
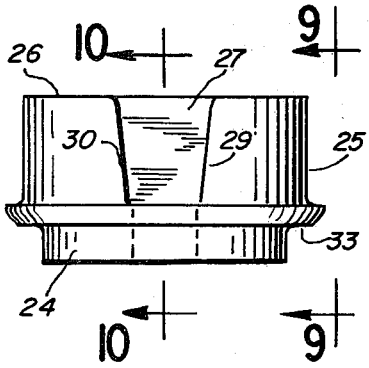
FIG. 8
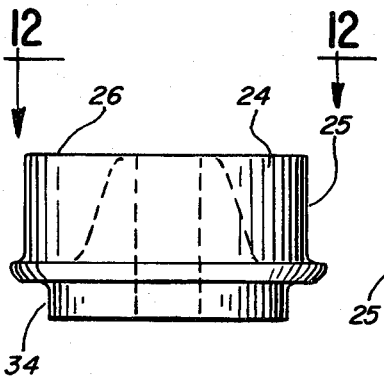
FIG. 9
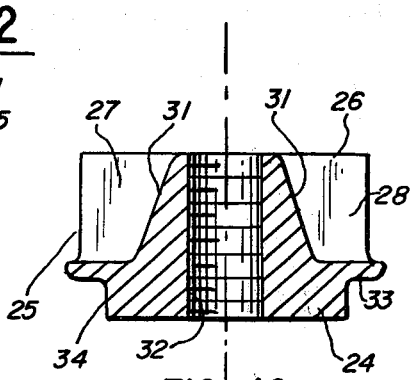
FIG. 10
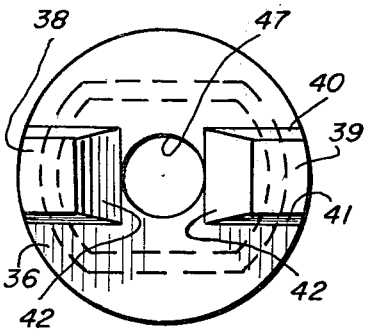
FIG. 11
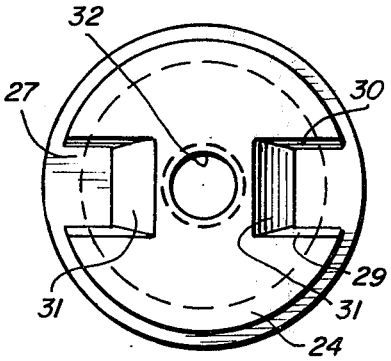
FIG. 12
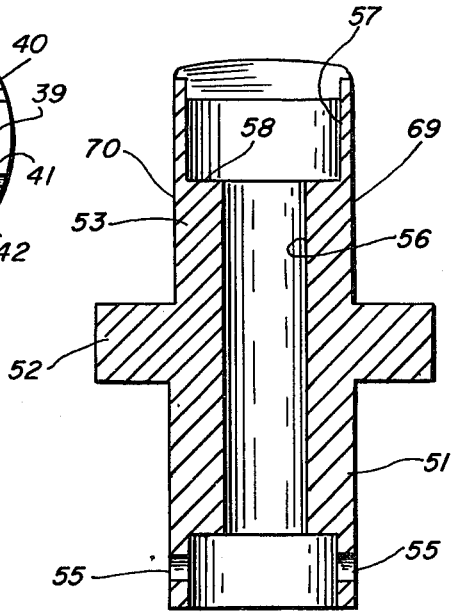
FIG. 13

REMOVABLE RUDDER ASSEMBLY

BACKGROUND AND SUMMARY

This invention relates to a rudder assembly for a boat, and, more particularly, to a rudder assembly which permits the rudder to be removed from below the hull.

In many sailboats the rudder is mounted inboard, i.e., the rudder shaft extends upwardly from the rudder through the hull of the boat. Since it is often desirable to remove the rudder, many boats are provided with means for permitting the rudder to be removed. For example, when the boat is transported on a trailer, removing the rudder will increase the clearance between the boat and the highway.

The length of the rudder shaft frequently prevents an inboard rudder from being removed from below the hull. In order to remove the rudder from below the hull, the hull must be raised above ground a sufficient distance to permit withdrawal of the rudder shaft from the hull. As a result, many removable rudders are withdrawn upwardly or in an aft direction. For example, U.S. Pat. Ser. No. 1,206,368 describes a rudder which is removed upwardly through a keyhole-shaped casing which is mounted in the hull. In U.S. Pat. Ser. No. 3,946,693 the rudder is also removed upwardly. In each of these patents the size of the rudder is limited by the size of the slot through which the rudder is removed. In U.S. Pat. Ser. No. 4,286,536 the rudder is removed in an aft direction within a slot which is formed in the hull. A lock member must be used to close the slot when the rudder is in position. U.S. Pat. Ser. No. 231,595 describes a rudder which is removed from below the hull. The rudder is held in engagement with the rudder post by a rope, and there is no rigid mechanical connection between the rudder and the post.

The invention provides for rapid and easy removal of the rudder from below the hull. The opening in the hull therefore need only accommodate the rudder shaft. The rudder shaft is formed in two parts so that only a short shaft portion is withdrawn from the hull. The two portions of the rudder shaft are joined by a pair of interconnecting plugs which lock the shaft portions against relative rotation and which provide a wedging action for a tight fit.

DESCRIPTION OF THE DRAWING

The invention will be explained in conjunction with an illustrative embodiment shown in the accompanying drawing, in which—

FIG. 5 is an elevational view of the upper connecting plug;

FIG. 6 is an elevational view of the upper connecting plug taken along the line 6—6 of FIG. 5;

FIG. 7 is a sectional view of the upper connecting plug taken along the line 7—7 of FIG. 5;

FIG. 8 is an elevational view of the lower connecting plug;

FIG. 9 is an elevational view of the lower connecting plug taken along the line 9—9 of FIG. 8;

FIG. 10 is a sectional view of the lower connecting plug taken along the line 10—10 of FIG. 8;

FIG. 11 is a bottom plan view of the upper connecting plug taken along the line 11—11 of FIG. 6;

FIG. 12 is a top plan view of the lower connecting plug taken along the line 12—12 of FIG. 9; and FIG. 13 is a sectional view of the rudder post head taken along the line 13—13 of FIG. 3.

DESCRIPTION OF SPECIFIC EMBODIMENT

Figure 1:
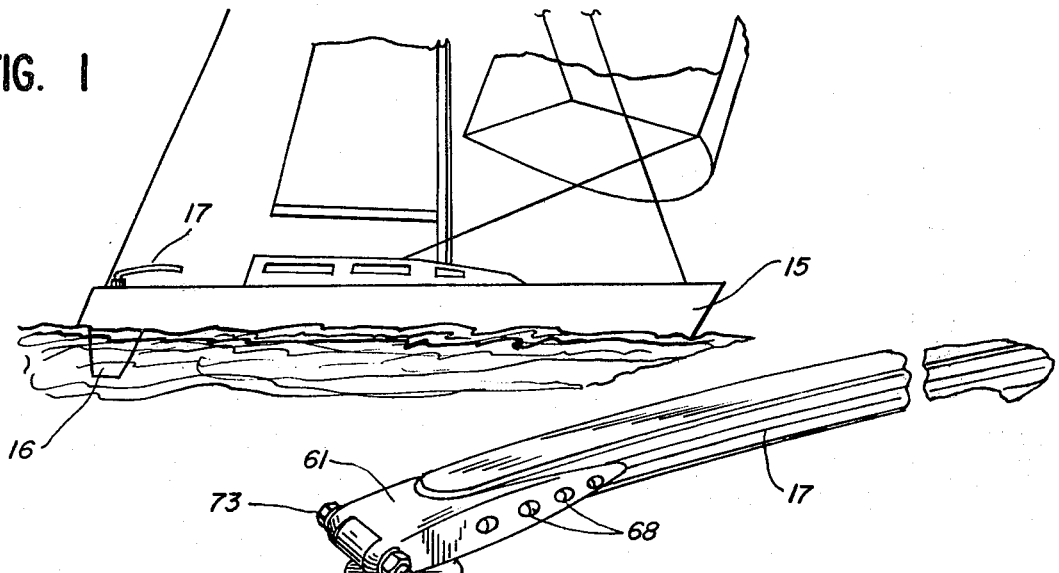
FIG. 1 is a side elevational view of a sailboat equipped with a rudder assembly formed in accordance with the invention.

Referring first to FIG. 1, a sailboat 15 is provided with an inboard rudder 16 near the stern. The rudder is operated by a tiller 17.

The tiller 17 is connected to a rudder post or shaft 18 (FIG. 2) which extends upwardly from the rudder 16. The rudder shaft extends through a cylindrical shaft support tube 19 which is mounted in the hull 20. The rudder shaft is segmented and is formed by a lower shaft 21 which is connected to the rudder and an upper shaft 22 which is connected to the tiller.

Figures 3, 4:
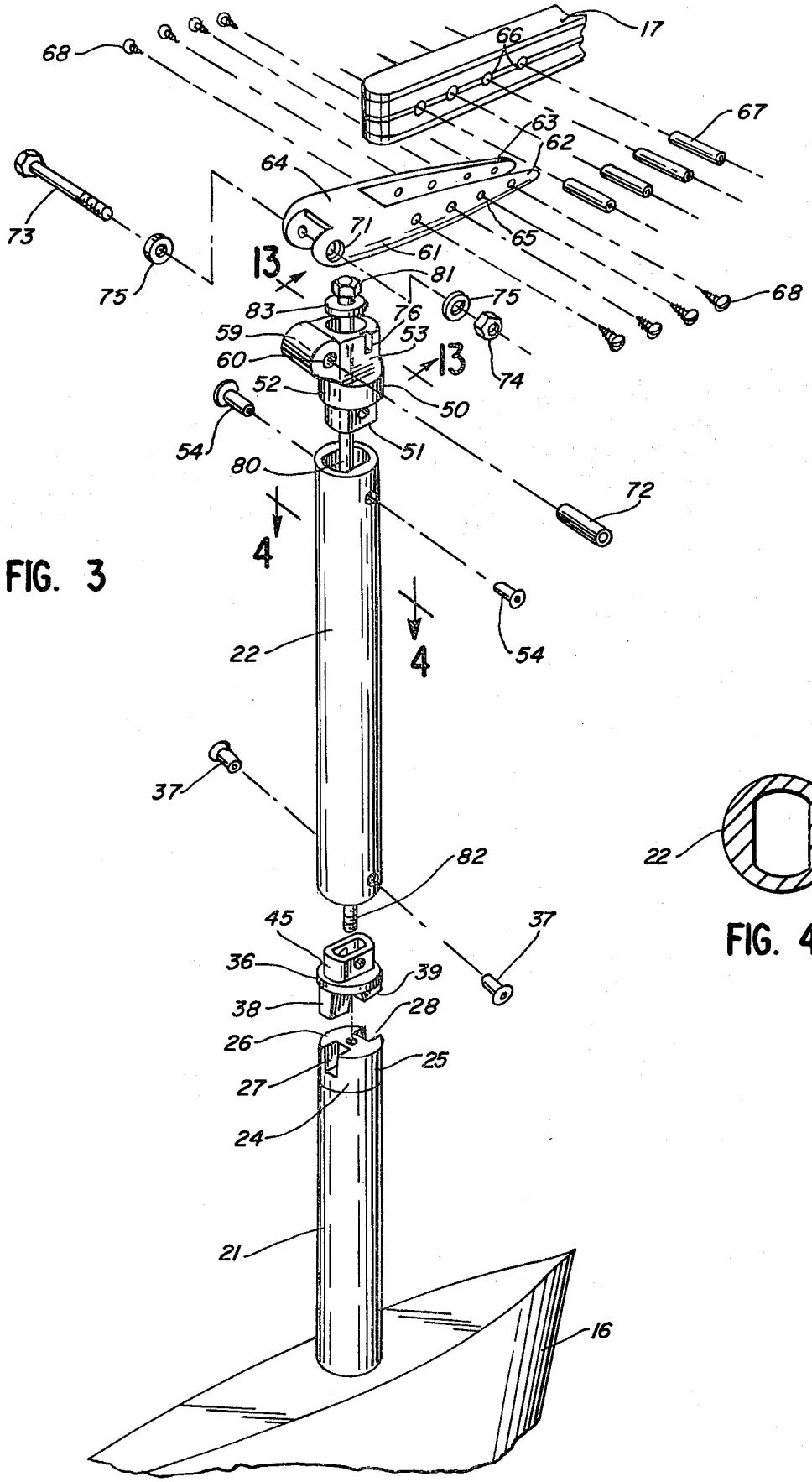
FIG. 3 is an exploded fragmentary perspective view of the rudder assembly.
FIG. 4 is a sectional view taken along the line 4—4 of FIG. 3.

Turning now to FIG. 3, the lower shaft 21 is formed from a cylindrical tube, and a connecting plug 24 is mounted on the upper end of the shaft. The connecting plug includes a cylindrical side surface 25 (see also FIGS. 8–10 and 12) and a flat top surface 26, and a pair of wedge-shaped recesses 27 and 28 are formed in the top and side surfaces. As can be seen in FIG. 8, each recess includes side walls 29 and 30 which are inclined toward each other from top to bottom, and an inside wall 31 which is inclined radially outwardly from top to bottom. An internally threaded hole 32 extends through the center of the plug between the two recesses. The recesses 27 and 28 terminate at a radially outwardly extending lip or shelf 33, and a cylindrical extension 34 projects below the lip. The extension 34 is sized to be snugly received within the lower rudder shaft 21, and the upper end of the shaft abuts the bottom of the lip 32. The connecting plug and the shaft can be permanently joined by a weld around the junction between the plug and the shaft. The connecting plug is advantageously formed by casting, and in one specific embodiment both the plug and the shaft were made from 316 stainless steel.

The upper rudder shaft 22 is also formed from a tube which has a cylindrical outer wall. However, the inside wall of the upper shaft is non-circular (FIG. 4). The upper shaft is advantageously extruded from aluminum.

A connecting plug 36 is inserted into the bottom end of the upper shaft and secured by rivets 37. The connecting plug 36 includes a pair of tongues or lugs 38 and 39 which are designed to provide a wedge fit in the recesses 27 and 28 of the lower connecting plug 24.

Referring to FIGS. 5–7 and 11, each of the tongues include side walls 40 and 41 which converge in a downward direction and an inside wall 42 which is inclined radially outwardly from top to bottom. When the upper and lower connecting plugs 36 and 24 are forced together, the inclined side walls 40 and 41 and inside walls 42 of the tongues wedge against the inclined side surfaces 29 and 30 and inclined inside surface 31, respectively, of the recesses in the lower connecting plug.

The tongues of the upper connecting plug extend downwardly from a circular lip or shelf 44, and a non-circular tubular portion 45 extends upwardly from the lip. The tubular portion has a non-circular outer surface which is shaped to fit snugly into the bottom end of the upper rudder shaft 22, and the non-circular shape prevents relative rotation between the plug and the shaft. The bottom of the shaft 22 abuts the lip 44, and the rivets 37 extend through holes 46 in the tubular portion 45 to retain the plug on the shaft. A center opening 47 extends through the upper connecting plug along the axis of the plug.

The upper connecting plug 36 is advantageously formed by investment casting stainless steel. The shape of the upper connecting plug and the upper rudder shaft permits these parts to be attached by rivets. This eliminates problems which might arise if the stainless steel connecting plug were welded to the aluminum rudder shaft. For example, not only would welding require more time and expense, but water-induced corrosion could ultimately weaken the connection between the parts.

Referring to FIGS. 3 and 13, a rudder post head 50 is mounted on the upper end of the upper rudder shaft 22 and provides the means for attaching the tiller 17 to the rudder shaft. The rudder post head is generally tubular in shape and includes a lower portion 51 which is inserted into the rudder shaft 22, a radially outwardly extending abutment flange 52, and an upper portion 53. The lower portion 51 is inserted into the upper rudder shaft 22 until the rudder shaft abuts the flange 52, and the rudder post head is connected to the rudder shaft by rivets 54 which extend through openings 55 in the lower portion. The external shape of the lower portion 51 corresponds to the internal configuration of the rudder shaft to prevent relative rotation of these parts. A central bore 56 (FIG. 13) extends through the rudder post head, and the top of the rudder post head is counterbored at 57 to provide an annular shoulder 58.

The upper portion of the rudder post head includes a rearwardly projecting knob portion 59 through which a tiller-attaching opening 60 extends. The opening 60 extends perpendicularly to the central bore 56 of the rudder post head.

A tiller fork 61 includes a pair of spaced-apart parallel arms 62 and 63 which are connected by a crossbar 64. The forward ends of the arms extend along the sides of the tiller and are provided with screw holes 65 which are alignable with holes 66 in the tiller. Internally threaded tubes 67 are inserted into the holes 66 in the tiller, and screws 68 are screwed into each of the tubes to attach the tiller fork to the tiller.

The spacing between the arms 62 and 63 of the tiller fork is slightly greater than the dimension between the side surfaces 69 and 70 (FIG. 13) of the rudder post head, and the arms of the tiller fork can fit over the rudder post head. The aft ends of the arms of the tiller fork are provided with openings 71 which are alignable with the opening 60 in the rudder post head. The tiller fork is pivotally attached to the rudder post head by a tubular bushing 72 which is inserted through the openings 60 and 71. The bushing is retained in position by a bolt 73 which extends through the bushing, a nut 74 which is threaded onto the bolt, and a pair of washers 75 at the ends of the bushing.

A vertically extending slot 76 (FIG. 3) is provided in each of the side surfaces 69 and 70 of the rudder post head and Delrin spacers are positioned in the slots. When the tiller is pivoted to the operating position illustrated in FIG. 2, the arms of the tiller fork will engage the Delrin spacers, and this engagement, in cooperation with the attachment of the tiller fork to the rudder post head by the bolt 73, will prevent relative rotation between the tiller fork and the rudder post head.

In the specific embodiment illustrated, the rudder post head was cast from aluminum. The central bore 56 and the tiller-attaching hole 60 were thereafter drilled in the cast part.

The upper and lower shafts are connected together by an elongated bolt or rod 80 (FIG. 3) which includes a bolt head 81 and a threaded lower end 82. The rod is inserted through the central bore 56 of the rudder post head, through the upper rudder shaft 22, and through the central opening 47 in the upper connecting plug 36. The threaded lower end 82 of the rod is then screwed into the threaded opening 32 in the lower connecting plug 24 to draw the lower connecting plug toward the upper connecting plug. A washer 83 is mounted on the rod below the bolt head 81, and as the rod is screwed into the lower connecting plug, the washer engages the shoulder 58 (FIG. 13) in the rudder post head. Access to the central bore of the rudder post head is provided by pivoting the tiller and the tiller fork about the bolt 73.

As the lower connecting plug is drawn toward the upper connecting plug by the rod 80, the rudder shafts are rotated until the tongues 38 and 39 of the upper connecting plug are aligned with the recesses 27 and 28 in the lower connecting plug. The rod is then tightened until the wedge-shaped tongues are firmly wedged within the wedge-shaped recesses. The wedge fit between the connecting plugs eliminates any slop or looseness in the connection between the upper and lower shafts and securely locks the rudder shafts together for common rotation. The interconnection between the tongues and the recesses also provides a self-aligning feature which ensures that the tiller will be properly positioned with respect to the rudder.

Figure 2:
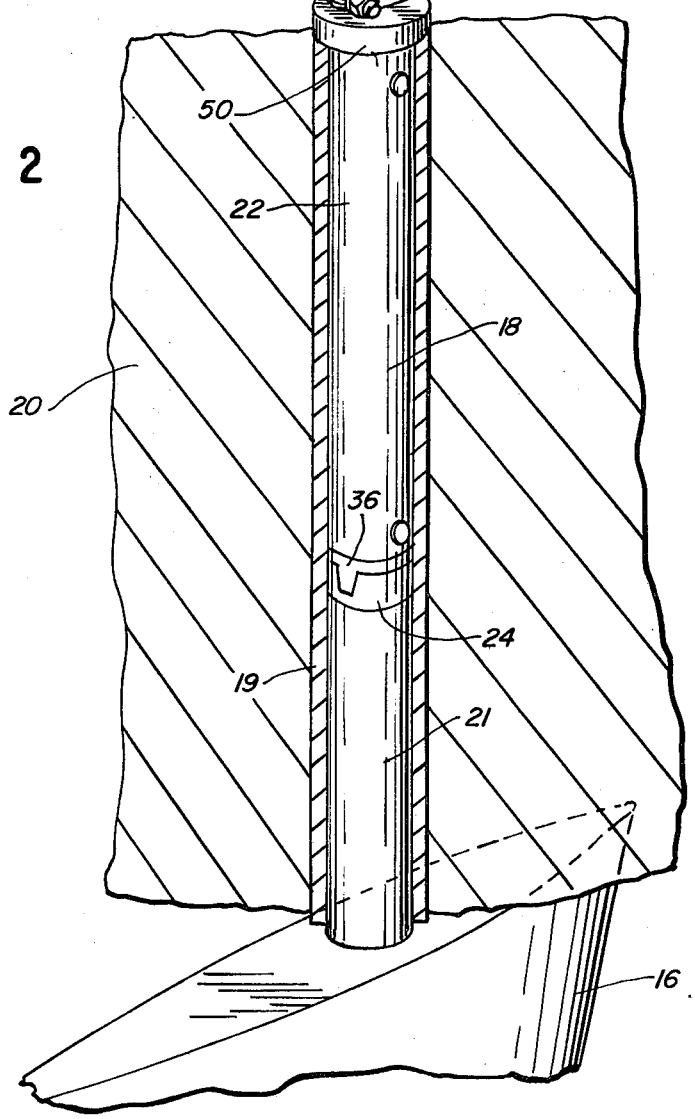
FIG. 2 is an enlarged fragmentary perspective view of the rudder assembly.

The rudder is then operated in the convention manner by the tiller. The upper and lower rudder shafts 21 and 22 are sized to rotate freely within the support tube 19 (FIG. 2). The flange 52 on the rudder post head 50 engages the upper end of the support tube and prevents the rudder shaft from dropping through the support tube. If desired, a bushing can be mounted on the lower rudder shaft adjacent the rudder for engaging the bottom of the support tube and for reducing friction between the rudder and the support tube.

When it is desired to remove the rudder, the tiller arm is pivoted to expose the bolt head 81 of the rod 80. The rod is unscrewed from the lower connecting plug by a conventional socket wrench which is sized to fit into the counterbore of the rudder post head. The rudder and the lower rudder shaft may then be withdrawn from the hull. The upper rudder shaft and the attached tiller can remain in position and will be supported by the support tube 19.

In one specific embodiment, the overall length of the rudder shaft between the rudder and the rudder post head was about 28 inches. However, the length of the lower rudder shaft 21 between the rudder and the lower connecting plug 24 was only about 10 inches. The rudder could therefore be removed from below the hull by providing sufficient clearance between the rudder and the ground to permit withdrawal of the lower rudder shaft and the attached lower connecting plug, i.e., a clearance of about 11 or 12 inches.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A removable rudder assembly for a boat comprising:

a rudder, a first rudder shaft extending upwardly from the rudder, a second rudder shaft extending upwardly from the first rudder shaft and extending coaxially with the first rudder shaft, and means for detachably connecting the first and second rudder shafts, the connecting means including a first connecting plug on the first rudder shaft and a second connecting plug on the second rudder shaft, operably engaging the first connecting plug, and locking means on the first and second connecting plugs for preventing relative rotation therebetween about the axis of the rudder shafts.

2. The rudder assembly of claim 1 including wedge means on the first and second connecting plugs for providing a wedging action as the connecting plugs move toward each other and means for urging the connecting plugs toward each other.

3. The rudder assembly of claim 2 in which said urging means comprises a rod which extends through the second rudder shaft and through the second connecting plug and which is threadedly engaged with the first connecting plug.

4. The rudder assembly of claim 2 in which said locking means and said wedge means comprise at least one wedge-shaped tongue on one of the connecting plugs and at least one wedge-shaped recess on the other connecting plug, said wedge-shaped tongue and wedge-shaped recess being interfitted to prevent relative rotation of said connecting plugs about the axis of the rudder shafts.

5. The rudder assembly of claim 1 in which said second rudder shaft is an extruded tube having a lower end with a non-circular inside surface, said second connecting plug including an upper end which has a shape corresponding to the inside surface of the lower end of the second rudder shaft and which is inserted into said lower end, and means for attaching the second connecting plug to the second rudder shaft.

6. The rudder assembly of claim 5 in which said attaching means comprises a rivet which extends through the lower end of the second rudder shaft and the upper end of the second connecting plug.

7. The rudder assembly of claim 5 in which said second rudder shaft includes an upper end having a non-circular inside surface, a tiller-attaching member having a lower end with a shape corresponding to the inside surface of the upper end of the second rudder shaft, the lower end of the tiller-attaching member being inserted into the upper end of the second rudder shaft, and means for attaching the tiller-attaching member to the second rudder shaft.

8. The rudder assembly of claim 7 in which said connecting means further includes a rod which extends through said tiller-attaching member, through said second rudder shaft, and through said second connecting plug and which is threadedly engaged with said first connecting plug.

9. The rudder assembly of claim 1 in which the connecting means further includes a rod which extends through said second rudder shaft and which is removably connected to said first rudder shaft.

* * * * *